US010800993B2

(12) United States Patent
Moody et al.

(10) Patent No.: US 10,800,993 B2
(45) Date of Patent: Oct. 13, 2020

(54) LUBRICATED SYSTEM COMPRISING A DLC SURFACE

(71) Applicant: Croda International Plc, East Yorkshire (GB)

(72) Inventors: Gareth Moody, Leeds West Yorkshire (GB); John Eastwood, Stockton-on-Tees Cleveland (GB); Aitziber Viadas Cienfuegos, York North Yorkshire (GB)

(73) Assignee: Croda International PLC (GB)

( * ) Notice: Subject to any disclaimer, the term of this patent is extended or adjusted under 35 U.S.C. 154(b) by 0 days.

(21) Appl. No.: 16/088,938

(22) PCT Filed: Mar. 14, 2017

(86) PCT No.: PCT/EP2017/056009
§ 371 (c)(1),
(2) Date: Sep. 27, 2018

(87) PCT Pub. No.: WO2017/174305
PCT Pub. Date: Oct. 12, 2017

(65) Prior Publication Data

US 2019/0112546 A1 Apr. 18, 2019

(30) Foreign Application Priority Data

Apr. 8, 2016 (GB) ..... 1606005.5

(51) Int. Cl.

| | |
|---|---|
| ***C10M 169/04*** | (2006.01) |
| ***C10M 161/00*** | (2006.01) |
| ***C10M 135/18*** | (2006.01) |
| ***C10M 145/02*** | (2006.01) |
| ***C10M 145/28*** | (2006.01) |
| *C10N 30/06* | (2006.01) |
| *C10N 40/25* | (2006.01) |
| *C10N 80/00* | (2006.01) |

(52) U.S. Cl.
CPC ..... *C10M 169/044* (2013.01); *C10M 135/18* (2013.01); *C10M 145/02* (2013.01); *C10M 145/28* (2013.01); *C10M 161/00* (2013.01); *C10M 2203/003* (2013.01); *C10M 2205/026* (2013.01); *C10M 2207/283* (2013.01); *C10M 2207/30* (2013.01); *C10M 2209/02* (2013.01); *C10M 2209/102* (2013.01); *C10M 2209/104* (2013.01); *C10M 2219/068* (2013.01); *C10N 2030/06* (2013.01); *C10N 2040/25* (2013.01); *C10N 2080/00* (2013.01)

(58) Field of Classification Search
CPC ..... C10M 2203/003; C10M 2219/068; C10M 2209/02; C10M 2209/104; C10N 2240/10; C10N 2010/14; C10N 2030/02; C10N 2030/06
See application file for complete search history.

(56) References Cited

U.S. PATENT DOCUMENTS

| | | | | |
|---|---|---|---|---|
| 2005/0119136 | A1* | 6/2005 | Castle | C10M 135/18 508/363 |
| 2015/0344811 | A1 | 12/2015 | Strong et al. | |
| 2015/0344812 | A1 | 12/2015 | Strong et al. | |
| 2016/0186084 | A1* | 6/2016 | Schilowitz | C01M 169/04 508/311 |
| 2016/0312144 | A1 | 10/2016 | De Barros Bouchet et al. | |

FOREIGN PATENT DOCUMENTS

| | | | |
|---|---|---|---|
| FR | 3014898 | A1 | 6/2015 |
| WO | 2011107739 | A1 | 9/2011 |
| WO | 2015193395 | A1 | 12/2015 |

OTHER PUBLICATIONS

International Search Report and Written Opinion for International Application No. PCT/EP2017/056009, dated May 30, 2017—11 pages.
Kosarieh et al., "The Effect of MoDTC-type Friction Modifier on the Wear Performance of a Hydrogenated DLC Coating", Wear, 2013, vol. 302, pp. 890-898.
Croda Europe Limited "The Use of Perfad 3006 As a Polymeric Friction Modifier in Automotive Engine Oil Formulations", Research Disclosure, Mason Publications, Dec. 1, 2016, vol. 632, No. 1, 10 pages.

* cited by examiner

*Primary Examiner* — Vishal V Vasisth
(74) *Attorney, Agent, or Firm* — RatnerPrestia

(57) ABSTRACT

The present invention relates to a lubricated system comprising: a) a component comprising a first surface which is a diamond-like carbon (DLC) surface; b) a component comprising a second surface; and c) a lubricant formulation interposed between the first surface and second surface. The lubricant formulation comprises: i) a base stock; ii) a molybdenum compound; iii) an organic polymer comprising a hydrophobic polymeric sub unit selected from polyesters and functionalised polyolefins and a hydrophilic polymeric sub unit selected from polyethers; and iv) optionally, other additives. The combination of the molybdenum compound and the organic polymer in the lubricant formulation reduces the wear on one or more of the surfaces in the lubricated system when compared with using the molybdenum containing friction modifier alone.

8 Claims, No Drawings

LUBRICATED SYSTEM COMPRISING A DLC SURFACE

CROSS REFERENCE TO RELATED APPLICATIONS

This application is the National Stage filing of International Appln. No. PCT/EP2017/056009, filed Mar. 14, 2017, and claims priority of GB Application No. 1606005.5, filed Apr. 8, 2016, the entirety of which applications is incorporated herein by reference for all purposes.

FIELD OF INVENTION

The present invention relates to a lubricated system comprising a diamond-like carbon (DLC) surface and the use of a lubricant formulation comprising a molybdenum compound and an organic polymer in the lubricated system. The organic polymer reduces the wear of one or more of the components of the lubricated system which occurs due to the interaction of the DLC surface and the molybdenum compound. The invention also provides a method of reducing wear and the use of the lubricant formulation to reduce wear.

BACKGROUND

Diamond like carbon (DLC) is class of carbon that has certain characteristics of diamond. Various types of DLC exist with different properties. By adding a DLC coating to a metal (e.g. steel) component in a lubricated system, the component can be made more durable and more resistant to wear. In certain lubrication conditions the DLC coating may have a lower coefficient of friction than steel. Both the friction and wear benefits are highly advantageous to automotive and industrial lubricated systems. DLC coatings are of interest in particular in the automotive industry where increased part lifetime and enhanced fuel economy are key targets.

The use of friction modifiers in lubricants (e.g. automotive engine oils) is well known but these friction modifiers have been previously developed for steel-steel interfaces. Far less is known about the lubrication of DLC-metal interfaces. DLC material may interact with friction modifiers and other surface active components in different ways to traditional steel, cast iron and aluminium surfaces. Molybdenum containing friction modifiers such as molybdenum dithiocarbamate (MoDTC) are known to offer good friction reducing properties on steel-steel interfaces. However, it has also been observed that molybdenum containing friction modifiers may increase the rate of wear in DLC interfaces (e.g. DLC-steel and DLC-DLC) by softening or degrading the DLC surface and causing increased wear to the components in the interface.

SUMMARY OF THE INVENTION

The present invention is based in part on the recognition by the inventors that using a combination of a molybdenum containing friction modifier (a molybdenum compound) and a type of organic polymer as additives in a lubricant formulation, the wear on one or more of the surfaces in a lubricated system comprising a DLC surface may be significantly lower than when using the molybdenum containing friction modifier alone. Without being bound by theory, the organic polymer may work as a friction reducing additive through physisorption to a lubricated surface at multiple points. This physisorption may also protect a DLC surface from adverse interaction with the molybdenum compound. In this way, the organic polymer may reduce or mitigate the wear that may be induced by the presence of the molybdenum compound. The organic polymer alone or in combination with the molybdenum compound may also advantageously reduce the friction in the lubricated system.

Viewed from a first aspect, the present invention provides a lubricated system comprising:

a) a component comprising a first surface which is a diamond-like carbon (DLC) surface;
b) a component comprising a second surface; and
c) a lubricant formulation interposed between the first surface and second surface, wherein the lubricant formulation comprises:
i) a base stock;
ii) a molybdenum compound;
iii) an organic polymer comprising a hydrophobic polymeric sub unit selected from polyesters and functionalised polyolefins and a hydrophilic polymeric sub unit selected from polyethers; and
iv) optionally, other additives.

The presence of the organic polymer in the lubricant formulation may advantageously reduce the wear which occurs on the first or second surface, preferably on the first surface, during operation of the lubricated system when compared with an equivalent lubricant formulation which comprises the molybdenum compound but does not comprise the organic polymer.

Viewed from a second aspect, the present invention provides a method of reducing wear in a lubricated system, wherein the lubricated system comprises a component with a DLC surface and wherein the method comprises the steps of:

a. providing a lubricant formulation to contact the DLC surface;
b. providing a molybdenum compound in the lubricant formulation to reduce friction in the lubricated system; and
c. providing an organic polymer comprising a hydrophobic polymeric sub unit selected from polyesters and functionalised polyolefins and a hydrophilic polymeric sub unit selected from polyethers in the lubricant formulation to reduce the rate of wear of the DLC surface caused by the molybdenum compound during operation of the lubricated system.

Viewed from a third aspect, the present invention provides the use of an organic polymer comprising a hydrophobic polymeric sub unit selected from polyesters and functionalised polyolefins and a hydrophilic polymeric sub unit selected from polyethers in a lubricant formulation in a lubricated system comprising a component with a DLC surface, to reduce the rate of wear of the DLC surface during operation of the lubricated system caused by a molybdenum compound in the lubricant formulation.

Viewed from a fourth aspect, the present invention provides a lubricant formulation as defined in the first aspect of the invention.

Any aspect of the invention may include any of the features described herein with regard to that aspect of the invention or any other aspects of the invention.

DETAILED DESCRIPTION OF THE INVENTION

It will be understood that any upper or lower quantity or range limit used herein may be independently combined.

It will be understood that, when describing the number of carbon atoms in a substituent group (e.g. 'C1 to C6'), the number refers to the total number of carbon atoms present in the substituent group, including any present in any branched groups. Additionally, when describing the number of carbon atoms in, for example fatty acids, this refers to the total number of carbon atoms including the one at the carboxylic acid, and any present in any branch groups.

All molecular weights defined herein are number average molecular weights unless otherwise stated. Such molecular weights may be determined by gel permeation chromatography (GPC) using methods well known in the art. The GPC data may be calibrated against a series of linear polystyrene standards.

Many of the chemicals which may be used to produce the composition of the present invention are obtained from natural sources. Such chemicals typically include a mixture of chemical species due to their natural origin. Due to the presence of such mixtures, various parameters defined herein can be an average value and may be non-integral.

The term 'sub unit' as used herein means a component part of a molecule or a reactant used to form the molecule.

Lubricated System

The lubricated system comprises:

a) a component comprising a first surface which is a diamond-like carbon (DLC) surface;
b) a component comprising a second surface; and
c) a lubricant formulation interposed between the first surface and second surface.

The lubricated system may be a system comprising at least two components which move relative to each other. The lubricant formulation may be interposed (or located) between the components to lubricate the relative movement of the components. The components may comprise a first component and a second component. The first component may comprise the first surface. The second component may comprise the second surface.

The lubricated system may be selected from an engine, a turbine, a gear box, a hydraulic system, a transmission, a pump and a compressor, preferably selected from an engine, a transmission and a gear box. The lubricated system may be an engine, preferably an automotive engine.

The first component may comprise at least 50 wt % metal, preferably at least 80 wt %, particularly at least 90 wt %, desirably at least 95 wt %. The first component may consist essentially of metal or be a metal component. The metal may be selected from iron, steel, nickel, aluminium, titanium and mixtures and alloys thereof, preferably selected from from iron, steel, aluminium and mixtures and alloys thereof, particularly selected from iron, steel and mixtures and alloys thereof. The first surface may be a DLC coating on a part or all of the first component, preferably a DLC coating on a part of the first component.

The second component may be a metal component. The metal may be selected from iron, steel, nickel, aluminium, titanium and mixtures and alloys thereof, preferably selected from from iron, steel, aluminium and mixtures and alloys thereof, particularly selected from iron, steel and mixtures and alloys thereof. Preferably the second component is a steel component.

Preferably the second surface is a metal surface, particularly an iron or steel surface, especially a steel surface.

Diamond-Like Carbon (DLC) Surface

The DLC surface may be a coating on a component, preferably on the first component, particularly on a part of the first component. The DLC surface may be formed on the component by physical or chemical deposition.

The DLC surface may comprise at least one DLC layer. The DLC layer may be at least 0.1 μm thick, preferably at least 0.5 μm, particularly at least 1 μm. The DLC layer may be at most 100 μm thick, preferably at most 50 μm, particularly at most 40 μm, desirably at most 30 μm.

The DLC surface may be amorphous, semi-crystalline or crystalline, preferably amorphous. The DLC surface may comprise carbon and/or a carbide, preferably carbon.

The DLC surface may comprise in the range from 40 to 99 wt % of carbon, preferably from 50 to 99 wt % of carbon, particularly from 60 to 99 wt % of carbon.

The DLC surface may be $sp^3$ hybridised. The DLC surface may be at least 40% $sp^3$ hybridised, preferably at least 50%, particularly at least 60%, desirably at least 70%. The DLC surface may be at most 95% $sp^3$ hybridised.

The DLC surface may comprise hydrogenated DLC and/or non-hydrogenated DLC.

Preferably the DLC surface comprises hydrogenated DLC. Preferably the DLC surface comprises hydrogenated DLC called a-C:H. Preferably the DLC coating comprises 1 to 60 wt % hydrogen, particularly 1 to 50 wt % hydrogen, desirably 1 to 40 wt % hydrogen.

The DLC surface may comprise non-hydrogenated DLC, for example non-hydrogenated DLC called a-C (amorphous carbon) and/or non-hydrogenated DLC called Ta-C (tetrahedral amorphous carbon).

The DLC surface may comprise a dopant. The dopant may be a metal and/or semiconductor. The dopant may be selected from silicon, iron, chromium, tungsten and mixtures thereof, preferably selected from chromium, tungsten and mixtures thereof. The DLC surface may comprise 0.01 to 10 wt % dopant, preferably 0.05 to 5 wt %, particularly 0.5 to 2 wt %.

Compared with pure diamond coatings, DLC coatings are generally less resistant mechanically and thermally because they are generally amorphous materials. However, DLC coatings may be deposited at low temperature on most substrates.

Molybdenum Containing Compounds

The molybdenum compound may be a friction modifier. The molybdenum compound may be an organo-molybdenum compound. The molybdenum compound may be selected from the group consisting of molybdenum dithiocarbamates (MoDTC), molybdenum dithiophosphates (MoDTP), molybdenum dithiophosphinates, molybdenum xanthates, molybdenum thioxanthates, molybdenum sulfides such as molybdenum disulphide ($MoS_2$), molybdenum dithiolate ($Mo(TDT)_3$), molybdenum/amine complexes, molybdenum/sulfur complexes and mixtures thereof.

The molybdenum compound may be an acidic molybdenum compound such as molybdic acid. The molybdenum compound may be an alkaline metal molybdate such as sodium molybdate or potassium molybdate. The molybdenum compound may be a molybdenum salt such as ammonium molybdate or a molybdenum oxide.

Preferably the molybdenum compound comprises a molybdenum dithiocarbamate (MoDTC). Examples of molybdenum dithiocarbamates include C4-C18 dialkyl or diaryldithiocarbamates, or alkyl-aryldithiocarbamates. For example, dibutyl-, diamyl-, di-(2-ethyl-hexyl)-, dilauryl-, dioleyl-, and dicyclohexyl-dithiocarbamate.

Another class of suitable organo-molybdenum compounds are trinuclear molybdenum compounds. Additional suitable molybdenum compounds are described in U.S. Pat. No. 6,723,685, herein incorporated by reference.

The molybdenum compound may be present in the lubricant formulation in an amount to provide about 5 ppm to 3000 ppm molybdenum, preferably about 50 to 2000 ppm, particularly about 100 to 1500 ppm.

The lubricant formulation may comprise at least 0.01 wt % molybdenum compound, preferably at least 0.05 wt %, particularly at least 0.1 wt %, desirably at least 0.5 wt %, especially at least 1 wt %. The lubricant formulation may comprise at most 15 wt % molybdenum compound, preferably at most 10 wt %, particularly at most 8 wt %, desirably at most 5 wt %.

Organic Polymer

The organic polymer comprises a hydrophobic polymeric sub unit selected from polyesters and functionalised polyolefins and a hydrophilic polymeric sub unit selected from polyethers.

The organic polymer may be a friction reducing additive. The organic polymer may be a copolymer. The organic polymer may be oil soluble. By oil soluble is meant that the organic polymer is soluble or stably dispersible in oil to an extent sufficient to exert its intended effect in the lubricant formulation.

As with all polymers, the organic polymer will typically comprise a mixture of molecules of various sizes. The organic polymer suitably has a number average molecular weight of from 1,000 to 30,000, preferably from 1,500 to 25,000, more preferably from 2,000 to 20,000 Daltons. The molecular weight of the organic polymer and/or its sub units may be measured by gel permeation chromatography (GPC). The GPC measurement may be calibrated against linear polystyrene standards.

The hydrophilic polymeric sub unit preferably comprises a polyalkylene glycol. The hydrophobic polymeric sub unit preferably comprises a functionalised polyolefin, particularly a polyolefin functionalised to comprise a diacid and/or anhydride group.

The organic polymer may be the reaction product of, and preferably is solely the reaction product of:

a) a first polymeric sub unit selected from polyesters and functionalised polyolefins,
b) a second polymeric sub unit selected from polyethers;
c) optionally a backbone moiety capable of linking the polymeric sub units; and
d) optionally a chain terminating group.

The first polymeric sub unit may be the hydrophobic polymeric sub unit and preferably is more hydrophobic that the second polymeric sub unit.

The second polymeric sub unit may be the hydrophillic polymeric sub unit and preferably is more hydrophillic that the first polymeric sub unit.

Preferably the backbone moiety is a polyol.

Preferably the chain terminating group is a fatty acid.

The first (hydrophobic) polymeric sub unit is selected from polyesters and functionalised polyolefins.

The polyester may be a polyhydroxycarboxylic acid and preferably comprises polyhydroxystearic acid.

The functionalised polyolefin is preferably derived from a polymer of a monoolefin having from 2 to 6 carbon atoms such as ethylene, propylene, butane and isobutene, more preferably isobutene, the said polymer containing a chain of from 15 to 500, preferably 50 to 200 carbon atoms. Preferably the functionalised polyolefin is functionalised polyisobutylene.

The second (hydrophillic) polymeric sub unit is selected from polyethers. The second (hydrophillic) polymeric sub unit may comprise a polyalkylene glycol. The polyalkylene glycol may be a polyethylene glycol (PEG), preferably a PEG having a (number average) molecular weight of 300 to 5,000 Da, more preferably 400 to 1000 Da, especially 400 to 800 Da. Alternatively, a mixed poly(ethylene-propylene glycol) or mixed poly(ethylene-butylene glycol) may be used. Exemplary polyethers for use in the present invention may be selected from $PEG_{400}$, $PEG_{600}$, $PEG_{1000}$, $PEG_{1500}$ and mixtures thereof.

The first polymeric sub unit may be either linear or branched. The second polymeric sub unit may be either linear or branched.

During the course of the reaction to form the organic polymer some of the first and second polymeric sub units may link together to form block copolymer units. When present the number of block copolymer units in the organic polymer typically ranges from 1 to 20 units, preferably 1 to 15, more preferably 1 to 10 and especially 1 to 7 units.

The first (hydrophobic) and/or second (hydrophillic) polymeric sub units may comprise functional groups which enable them to link with the other sub unit. For example the first polymeric sub unit may be functionalised so that it has a diacid/anhydride group by reaction with an unsaturated diacid or anhydride, for example maleic anhydride. The diacid/anhydride can react by esterification with hydroxyl terminated second polymeric sub units, for example a polyalkylene glycol. Preferably the first polymeric subunit comprises a polyolefin functionalised to comprise a diacid and/or anhydride group, particularly a succinic anhydride group.

In a further example the first polymeric sub unit may be functionalised by an epoxidation reaction with a peracid, for example perbenzoic or peracetic acid. The epoxide can then react with hydroxyl and/or acid terminated second polymeric sub units.

In a further example a second polymeric sub unit which has a hydroxyl group may be derivatised by esterification with unsaturated mono carboxylic acids, for example vinyl acids, specifically acrylic or methacrylic acid. This derivatised second polymeric sub unit can then react with a polyolefin first polymeric sub unit by free radical copolymerisation.

A particularly preferred first polymeric sub unit comprises polyisobutylene which has been functionalised by maleinisation to form polyisobutylene succinic anhydride (PIBSA) having a molecular weight (number average) in the range of 300 to 5000 Da, preferably 500 to 1500 Da, especially 800 to 1200 Da. Polyisobutylene succinic anhydrides are commercially available compounds made by an addition reaction between polyisobutene having a terminal unsaturated group and maleic anhydride. Preferably the hydrophobic polymeric sub unit comprises a polyisobutylene succinic anhydride.

The first and second polymeric sub units may be directly linked to each other in the organic polymer and/or they may be linked together by the at least one backbone moiety. Preferably they are linked together by the at least one backbone moiety. The backbone moiety may be selected from polyols and polycarboxylic acids, and is preferably a polyol. Preferably, the organic polymer further comprises a polyol.

The polyol may be a diol, triol, tetrol and/or related dimers or trimers or chain extended polymers of such compounds. The polyol may be selected from glycerol, polyglycerol, neopentyl glycol, trimethylolethane, trimethylolpropane, trimethylolbutane, pentaerythritol, dipentaerythritol, tripentaerythritol, sucrose, sorbitan, sorbitol and mixtures thereof. Preferably the polyol is selected from glycerol, polyglycerol, trimethylolpropane, sorbitan and sorbitol, particularly selected from glycerol, polyglycerol, and sorbitol. In a preferred embodiment the polyol is glycerol.

The backbone moiety may be a polycarboxylic acid, for example a di- or tricarboxylic acid. Dicarboxylic acids are preferred polycarboxylic acid backbone moieties, particularly straight chained dicarboxylic acids. Particularly suitable are straight chained dicarboxylic acids having a chain length of between 2 and 10 carbon atoms. Preferably the polycarboxylic acid is selected from oxalic, malonic, succinic, glutaric, adipic, pimelic, suberic, azelaic sebacic acid and mixtures thereof, particularly selected from adipic, azelaic and sebacic acid and mixtures thereof. Unsaturated dicarboxylic acids such as maleic acid may also be suitable. A particularly preferred polycarboxylic acid backbone moiety is adipic acid.

When the product of the reaction to form the organic polymer ends in a reactive group (e.g. as with the OH in a polyalkylene glycol), it may be desirable or useful in some circumstances to add a chain terminating group to the end of the reaction product. For example, attaching a carboxylic acid to an exposed hydroxyl group on a polyalkylene glycol via an ester linkage. The chain terminating group is preferably a fatty carboxylic acid (fatty acid). Suitable fatty acids include C12 to C22 fatty acids. The fatty acid may be linear saturated, branched saturated, linear unsaturated or branched unsaturated. The chain terminating group may be selected from lauric acid, erucic acid, stearic acid, isostearic acid, palmitic acid, oleic acid and linoleic acid, preferably palmitic acid, oleic acid and linoleic acid. A particularly preferred chain terminating group is tall oil fatty acid (TOFA), a derivative of tall oil, which is primarily oleic acid.

In a preferred embodiment the organic polymer is a reaction product of a polyisobutylene succinic anhydride, a polyalkylene glycol (preferably PEG), a polyol (preferably glycerol) and a dicarboxylic acid (preferably adipic, azelaic or sebacic acid).

The lubricant formulation may comprise at least 0.01 wt % of the organic polymer, preferably at least 0.05 wt %, particularly at least 0.1 wt %, desirably at least 0.5 wt %, especially at least 1 wt %. The lubricant formulation may comprise at most 20 wt % of the organic polymer, preferably at most 15 wt %, particularly at most 10 wt %, desirably at most 8 wt %, especially at most 5 wt %.

Lubricant Formulation

The lubricant formulation comprises:

i) a base stock;

ii) a molybdenum compound;

iii) an organic polymer; and iv) optionally, other additives;

The lubricant formulation may be selected from an engine oil, a turbine oil, a gear oil, a hydraulic oil, a pump oil, a transmission oil, a marine oil and a compressor oil, preferably selected from an engine oil, a transmission oil, a gear oil and a marine oil. The lubricant formulation may be an engine oil, preferably an automotive engine oil. An automotive engine oil includes gasoline, diesel, and heavy duty diesel (HDDEO) engine oils.

The weight ratio of molybdenum compound to organic polymer in the lubricant formulation may be from 10:1 to 1:10, preferably from 8:1 to 1:8, particularly from 4:1 to 1:4, desirably from 3:1 to 1:3 and especially from 2:1 to 1:2.

The weight ratio of molybdenum compound to other additives (not including the organic polymer) in the lubricant formulation may be from 4:1 to 1:20, preferably from 2:1 to 1:10, particularly from 1:1 to 1:10.

The weight ratio of organic polymer to other additives (not including the molybdenum compound) in the lubricant formulation may be from 4:1 to 1:20, preferably from 2:1 to 1:10, particularly from 1:1 to 1:10.

The lubricant formulation may comprise at least 60 wt % base stock, preferably at least 70 wt %, particularly at least 80 wt %. The lubricant formulation may comprise at most 95 wt % base stock, preferably at most 90 wt % base stock. The lubricant formulation may comprise a remainder of base stock (e.g. the base stock makes the formulation up to 100 wt % after the molybdenum compound, organic polymer and optional other additives are included).

The lubricant formulation is preferably non-aqueous. However, components of the lubricant formulation may contain small amounts of residual water (e.g. moisture). The lubricant formulation may comprise less than 5 wt % water in total, preferably less than 2 wt % water, particularly less than 1 wt % water, desirably less than 0.5 wt % water.

The choice of lubricant base stock (also known as base oil) may affect lubricant properties such as oxidation and thermal stability, volatility, low temperature fluidity, solvency of additives, contaminants and degradation products, and viscosity. The American Petroleum Institute (API) currently defines five groups of lubricant base stocks (API Publication 1509).

Groups I, II and III are mineral oils which are classified by the amount of saturates and sulphur they contain and by their viscosity indices. Table 1 below illustrates these API classifications for Groups I, II and III.

TABLE 1

| Group | Saturates | Sulphur | Viscosity Index (VI) |
|---|---|---|---|
| I | <90% | >0.03% | 80-120 |
| II | At least 90% | Not more than 0.03% | 80-120 |
| III | At least 90% | Not more than 0.03% | At least 120 |

Group I base stocks are solvent refined mineral oils, which are the least expensive base stock to produce, and currently account for the majority of base stock sales. They provide satisfactory oxidation stability, volatility, low temperature performance and traction properties and have very good solvency for additives and contaminants. Group II base stocks are mostly hydroprocessed mineral oils, which typically provide improved volatility and oxidation stability as compared to Group I base stocks. Group III base stocks (which includes Group III+ gas to liquid) are severely hydroprocessed mineral oils or they can be produced via wax or paraffin isomerisation. They are known to have better oxidation stability and volatility than Group I and II base stocks but have a limited range of commercially available viscosities.

Group IV base stocks differ from Groups I to III in that they are synthetic base stocks e.g. polyalphaolefins (PAOs). PAOs have good oxidative stability, volatility and low pour points. Disadvantages include moderate solubility of polar additives, for example antiwear additives.

Group V base stocks are all base stocks that are not included in the other Groups. Examples include alkyl naphthalenes, alkyl aromatics, vegetable oils, esters (including polyol esters, diesters and monoesters), polycarbonates, silicone oils and polyalkylene glycols.

Preferably the base stock is selected from the group consisting of an API Group I, II, III, IV, V base stock or mixtures thereof. If the base stock includes a polyalphaolefin (PAO) from Group IV then the base stock may also include a mineral oil from Group I, II or III or an ester from Group V. The base stock may be a mixture of Group IV and Group V base stocks or Group IV and Group I, II or III base stocks.

Preferably the base stock has one of Group II, Group III or a Group IV base stock as its major component, especially Group III. By major component it is meant at least 50% by weight of base stock, preferably at least 65%, more preferably at least 75%, especially at least 85%.

The base stock may also comprise as a minor component, preferably less than 30% by weight, more preferably less than 20%, especially less than 10% of any or a mixture of Group III+, IV and/or Group V base stocks which have not been used as the major component in the base stock. Examples of such Group V base stocks include alkyl naphthalenes, alkyl aromatics, vegetable oils, esters, for example monoesters, diesters and polyol esters, polycarbonates, silicone oils and polyalkylene glycols. More than one type of Group V base stock may be present. Preferred Group V base stocks are esters, particularly polyol esters.

To adapt the lubricant formulation to its intended use, the lubricant formulation may comprise one or more of the following other additives.

1. Dispersants: for example, alkenyl succinimides, alkenyl succinate esters, alkenyl succinimides modified with other organic compounds, alkenyl succinimides modified by post-treatment with ethylene carbonate or boric acid, pentaerythritols, phenate-salicylates and their post-treated analogs, alkali metal or mixed alkali metal, alkaline earth metal borates, dispersions of hydrated alkali metal borates, dispersions of alkaline-earth metal borates, polyamide ashless dispersants and the like or mixtures of such dispersants.

2. Anti-oxidants: additives which reduce the tendency of mineral oils to deteriorate in service which deterioration is evidenced by the products of oxidation such as sludge and varnish-like deposits on the metal surfaces and by an increase in viscosity. Examples of anti-oxidants include phenol type (phenolic) oxidation inhibitors, such as 4,4'-methylene-bis(2,6-di-tert-butylphenol), 4,4'-bis(2,6-di-tert-butylphenol), 4,4'-bis(2-methyl-6-tert-butylphenol), 2,2'-methylene-bis(4-methyl-6-tert-butyl-phenol), 4,4'-butylidene-bis(3-methyl-6-tert-butyl-phenol), 4,4'-isopropylidene-bis(2,6-di-tert-butylphenol), 2,2'-methylene-bis(4-methyl-6-nonylphenol), 2,2'-isobutylidene-bis(4,6-dimethylphenol), 2,2'-methylene-bis(4-methyl-6-cyclohexylphenol), 2,6-di-tert-butyl-4-methylphenol, 2,6-di-tert-butyl-4-ethylphenol, 2,6-di-tert-butylphenol, 2,4-dimethyl-6-tert-butyl-phenol, 2,6-di-tert-butyl-dimethylamino-p-cresol, 2,6-di-tert-4-(N,N'-dimethylamino-methylphenol), 4,4'-thiobis(2-methyl-6-tert-butylphenol), 2,2'-thiobis(4-methyl-6-tert-butylphenol), bis(3-methyl-4-hydroxy-5-tert-butylbenzyl)-sulfide, and bis(3,5-di-tert-butyl-4-hydroxybenzyl). Other types of oxidation inhibitors include alkylated diphenylamines (e.g., Irganox L-57 ex Ciba-Geigy), metal dithiocarbamate (e.g., zinc dithiocarbamate), and methylenebis(dibutyldithiocarbamate).

3. Anti-wear agents: as their name implies, these agents reduce wear of moving metallic parts. Examples of such agents include, but are not limited to, phosphates, phosphites, carbamates, esters, sulfur containing compounds.

4. Emulsifiers: for example, linear alcohol ethoxylates, including TERGITOL® 15-S-3 available from the Dow Chemical Company.

5. Demulsifiers: for example, addition products of alkylphenol and ethylene oxide, polyoxyethylene alkyl ethers, and polyoxyethylene sorbitan esters.

6. Extreme pressure agents (EP agents): for example, zinc dialkyldithiophosphates (ZDDP) such as primary alkyl, secondary alkyl, and aryl type ZDDP, sulfurized oils, diphenyl sulfide, methyl trichlorostearate, chlorinated naphthalene, fluoroalkylpolysiloxane, and lead naphthenate. A preferred EP agent is ZDDP.

7. Viscosity index improvers: for example, polymethacrylate polymers, ethylene-propylene copolymers, styrene-isoprene copolymers, hydrogenated styrene-isoprene copolymers, polyisobutylene, and dispersant type viscosity index improvers.

8. Pour point depressants: for example, polymethacrylate polymers.

9. Foam inhibitors: for example, alkyl methacrylate polymers and dimethyl silicone polymers.

The lubricant formulation may comprise at least 1 wt % other additives, preferably at least 2 wt %, particularly at least 4 wt %, desirably at least 8 wt %, especially at least 10 wt %. The lubricant formulation may comprise at most 20 wt % other additives, preferably at most 15 wt %, particularly at most 10 wt %.

Friction Reduction

Preferably the lubricant formulation reduces the friction in the lubricated system when compared with an equivalent lubricant formulation which does not comprise the molybdenum compound and does not comprise the organic polymer. The friction may be measured by MTM (as described herein). The friction may be measured at 80° C. The friction may be measured between 0.01 m/s and 0.1 m/s. The lubricant formulation may reduce the kinetic co-efficient of friction by at least 1%, preferably by at least 5% in the lubricated system when compared with an equivalent lubricant formulation which does not comprise the molybdenum compound and does not comprise the organic polymer.

The lubricant formulation may reduce the kinetic co-efficient of friction in the lubricated system when compared with an equivalent lubricant formulation which comprises the molybdenum compound but does not comprise the organic polymer. The kinetic co-efficient of friction may be measured at 0.1 m/s.

Wear Reduction

The lubricant formulation may reduce the wear (rate of wear) of a surface of a component in the lubricated system. The wear may be measured by MTM (as described herein). Preferably the surface is a DLC surface. The surface may be a metal surface, preferably a steel surface. The lubricant formulation may reduce the wear of a DLC and/or a metal surface.

The lubricant formulation may reduce the wear (rate of wear) of a surface of a component in the lubricated system when compared with an equivalent lubricant formulation which does not comprise the molybdenum compound and does not comprise the organic polymer. The lubricant formulation may reduce the wear of the surface by at least 10%, preferably by at least 30%, particularly by at least 50%, desirably by at least 70% when compared with an equivalent lubricant formulation which does not comprise the molybdenum compound and does not comprise the organic polymer. Preferably the surface is a DLC surface.

The lubricant formulation may provide a greater reduction in wear when compared with an equivalent lubricant formulation which comprises the molybdenum compound but does not comprise the organic polymer. The lubricant formulation may reduce the wear of a surface by at least 10%, preferably by at least 30%, particularly by at least 50%, desirably by at least 70%, especially by at least 90% when compared with an equivalent lubricant formulation which comprises the molybdenum compound but does not comprise the organic polymer. Preferably the surface is a DLC surface.

Any or all of the disclosed features, and/or any or all of the steps of any method or process described, may be used in any aspect of the invention.

EXAMPLES

The invention is illustrated by the following non-limiting examples.

It will be understood that all test procedures and physical parameters described herein have been determined at atmospheric pressure and room temperature (i.e. about 20° C.), unless otherwise stated herein, or unless otherwise stated in the referenced test methods and procedures. All parts and percentages are given by weight unless otherwise stated.

Test Methods

In this specification, the following test methods have been used:

(i) A Mini Traction Machine (MTM) ball on disc tribometer was used to test the friction and wear. The MTM was supplied by PCS Instruments of London, UK. This machine provides a method for measuring the kinetic coefficient of friction of a given lubricant formulation using a ball-on-disc configuration whilst varying several properties such as speed, load and temperature. The following conditions were used with the MTM:

50 ml lubricant formulation sample

80° C. test temperature

Pure sliding friction regime

Entrainment speeds between 0.01 m/s and 0.1 m/s 1.01 GPa contact pressure 120 minutes duration The MTM DLC ball was steel coated with a-C:H DLC material ($sp^3$~50%, H~40%), supplied by PCS instruments (1600 HV).

The MTM disc was AISI 52100 steel (760 HV).

The MTM steel ball was AISI 52100 steel (760 HV).

(ii) Kinetic co-efficient of friction was measured using the MTM initially and after 120 minutes.

(iii) Wear was measured using a Bruker Contour-GT non-contact 3D optical profiler to measure the width and depth of the wear scar on ball and disc, allowing a wear volume to be calculated. The wear was measured after the 120 minutes of friction testing had been performed.

(iv) Acid value is defined as the number of mg of potassium hydroxide required to neutralise the free acids in 1 g of sample, and was measured by direct titration with a standard potassium hydroxide solution.

(v) The hydroxyl value is defined as the number of mg of potassium hydroxide equivalent to the hydroxyl content of 1 g of sample, and was measured by acetylation followed by hydrolysation of excess acetic anhydride. The acetic acid formed was subsequently titrated with an ethanolic potassium hydroxide solution.

(vi) The saponification (or SAP) value is defined as the number of mg of potassium hydroxide required for the complete saponification of 1 g of sample, and was measured by saponification with a standard potassium hydroxide solution, followed by titration with a standard sulphuric acid solution.

(vii) Viscosity was measured at 0.1 Hz (6 rpm) with a Brookfield LVT viscometer using an appropriate spindle (LV1, LV2, LV3, or LV4) depending on the viscosity of the sample.

Example 1

Additive A

Additive A, an organic polymer was prepared as follows.

The first polymeric sub unit in Additive A is a commercially available maleinised polyisobutylene derived from a polyisobutylene of average molecular weight 1000 amu with an approximate degree of maleinisation of 78% and a saponification value of 85 mg KOH/g.

The second polymeric sub unit in Additive A is a commercially available poly(ethyleneoxide), $PEG_{600}$, having a hydroxyl value of 190 mg KOH/g.

Maleinised polyisobutylene (113.7 g) and glycerol (5.5 g), were charged to a glass round bottomed flask equipped with mechanical stirrer, isomantle heater and overhead condenser and reacted at 100 to 130° C. under nitrogen atmosphere for 4 hrs. $PEG_{600}$ (71.8 g) and esterification catalyst tetrabutyl titanate (0.4 g) were added, and reaction continued at 200 to 220° C. with removal of water and reduced pressure to an acid value of <6 mg KOH/g. Adipic acid (8.8 g) was added and reaction continued under the same conditions to acid value of <5 mg KOH/g.

The final product polyester, Additive A, was a dark brown liquid with viscosity at 100° C. of approximately 3500 cP (mPas).

Example 2

Additive B

Additive B, an organic polymer was prepared as follows.

The first polymeric sub unit is a commercially available maleinised polyisobutylene derived from a polyisobutylene of average molecular weight 950 amu with an approximate saponification value of 98 mg KOH/g.

The second polymeric sub unit is a commercially available poly (ethyleneoxide), $PEG_{600}$, having a hydroxyl value of 190 mg KOH/g.

Maleinised polyisobutylene, (110 g), $PEG_{600}$ (72 g), glycerol (5 g) and tall oil fatty acid (25 g) were charged to a glass round bottomed flask equipped with mechanical stirrer, isomantle heater and overhead condenser and reacted with esterification catalyst tetrabutyl titanate (0.1 g) at 200 to 220° C. with removal of water to final acid value of <10 mg KOH/g.

The final product polyester, Additive B, was a dark brown, viscous liquid.

Example 3

Additive C

Additive C, an organic polymer was prepared as follows.

The first polymeric sub unit is a commercially available maleinised polyisobutylene, derived from a polyisobutylene of average molecular weight 1000 amu, with an approximate saponification value 95 mg KOH/g.

The second polymeric sub unit is a commercially available poly(ethyleneoxide), $PEG_{600}$, having a hydroxyl value of 190 mg KOH/g.

Maleinised polyisobutylene, (100 g), $PEG_{600}$ (70 g) and tall oil fatty acid (25 g) were charged to a glass round bottomed flask equipped with mechanical stirrer, isomantle heater, overhead condenser and Dean and Stark separator and reacted with entraining solvent xylene (25 g) under reflux with water removal to final acid value <10 mg KOH/g. At the end of reaction, residual xylene was stripped off under reduced pressure to give product polyester, Additive C, as a brown viscous liquid.

Example 4

Lubricant formulation samples 1 to 4 were prepared. The composition of samples 1 to 4 is given in Table 2.

TABLE 2

| Sample | Composition |
|---|---|
| 1 (comparative) | 5W30 automotive engine oil (Helix Ultra Extra, ex Shell) |
| 2 (comparative) | Sample 1 + 0.5 wt % MoDTC molybdenum compound (Molyvan 855, ex Vanderbilt) |
| 3 (comparative) | Sample 1 + 0.5 wt % Additive A of Example 1 (organic polymer) |
| 4 | Sample 1 + 0.5 wt % MoDTC + 0.5 wt % Additive A |

Example 5

The MTM was used with the settings described herein (under Test Methods) to investigate friction and wear on the steel disc and DLC coated ball when lubricated by Samples 1 to 4 of Example 4 under varying conditions. The friction results are given in Table 3. The wear results were measured after the friction analysis was performed and are given in Table 4.

TABLE 3

| | Initial kinetic co-efficient of friction (CoF) at 0.01 m/s (0 mins) | | Final CoF at 0.01 m/s (120 mins) | | Initial CoF at 0.1 m/s (0 mins) | | Final CoF at 0.1 m/s (120 mins) | |
|---|---|---|---|---|---|---|---|---|
| Sample | CoF value | % change vs sample 1 | CoF Value | % change vs sample 1 | CoF value | % change vs sample 1 | CoF value | % change vs sample 1 |
| 1 | 0.118 | N/A | 0.107 | N/A | 0.102 | N/A | 0.103 | N/A |
| 2 | 0.119 | +1% | 0.093 | −13% | 0.122 | +20% | 0.086 | −16% |
| 3 | 0.109 | −8% | 0.105 | −2% | 0.108 | +6% | 0.092 | −10% |
| 4 | 0.092 | −22% | 0.100 | −7% | 0.096 | −6% | 0.084 | −18% |

Friction

It can be seen from Table 3 that at 0.01 m/s the greatest initial friction reduction was provided by sample 4 with a reduction of 22% compared with sample 1. At 0.1 m/s the greatest initial friction reduction was provided by sample 4 with a reduction of 6% compared with sample 1. At 0.1 m/s the greatest final friction reduction was provided by sample 4 with a reduction of 18% compared with sample 1.

Sample 4 which includes the combination of 0.5 wt % MoDTC and 0.5 wt % Additive A according to the invention was the only sample which reduced friction compared with sample 1 under all conditions tested in Table 2 i.e. there were no increases in friction with sample 4.

Therefore it can be seen that the combination of 0.5 wt % MoDTC and 0.5 wt % Additive A in sample 4 provides an advantage in terms of friction reduction when compared with comparative samples 1 to 3.

TABLE 4

| | Ball wear (DLC) | | Disc wear (Steel) | |
|---|---|---|---|---|
| Sample | Wear ($\mu m^3$) | % change vs sample 1 | Wear ($\mu m^3$) | % change vs sample 1 |
| 1 | 4114 | N/A | 12591 ± 2145 | N/A |
| 2 | 9897 | +141% | 69536 ± 441 | +452% ± 18 |
| 3 | 425 | −90% | 6036 ± 899 | −52% ± 32 |
| 4 | 788 | −81% | 1389 ± 131 | −89% ± 26 |

Wear

The results in Table 4 were measured after the friction analysis of Table 3 was performed. In other words, the wear was measured after 120 mins of contact.

It can be seen from Table 4 that comparative sample 2 including a molybdenum compound without Additive A greatly increases the wear on both the ball and disc. Without being bound by theory, it is believed that the presence of the molybdenum compound may act to 'soften' the DLC surface and cause uneven wear on the DLC surface. Since the DLC surface is still harder than the steel surface, this wear on the DLC surface also appears to cause greater wear on the softer steel surface. The addition of the organic polymer Additive A to the lubricant formulation appears to inhibit this effect of the molybdenum compound on the DLC surface. This can be seen in Sample 4 according to the invention which reduced the wear in the DLC ball by 81% (788 $\mu m^3$) and reduced the wear in the steel disc by 89% (1389 $\mu m^3$).

Therefore it can be seen that the combination of 0.5 wt % MoDTC and 0.5 wt % Additive A in sample 4 provides an advantage in terms of wear reduction when compared with comparative sample 2.

Example 6

In comparison with the wear results of Table 4, a steel ball and steel disc were tested for wear under the same conditions. The results are given in Table 5.

TABLE 5

| | Ball wear (Steel) | | Disc wear (Steel) | |
|---|---|---|---|---|
| Sample | Wear ($\mu m^3$) | % change vs sample 1 | Wear ($\mu m^3$) | % change vs sample 1 |
| 1 | 116183 | N/A | 36505 | N/A |
| 2 | 150452 | +29% | 20121 | −45% ± 11 |
| 3 | 79777 | −31% | 27354 | −25% ± 6 |
| 4 | 150230 | +29% | 24200 | −34% ± 15 |

It can be seen from Table 5 that sample 2 with the molybdenum compound did not have the same effect of causing wear in the steel-steel system when compared with the steel-DLC system of Table 4.

It is to be understood that the invention is not to be limited to the details of the above embodiments, which are described by way of example only. Many variations are possible.

The invention claimed is:

1. A lubricated system comprising:

a) a component comprising a first surface which is a diamond-like carbon (DLC) surface;

b) a component comprising a second surface; and c) a lubricant formulation interposed between the first surface and second surface, wherein the lubricant formulation comprises:

i) a base stock;

ii) 0.05 to 5 wt % of the lubricant formulation of a molybdenum compound comprising a molybdenum dithiocarbamate (MoDTC);

iii) 0.05 to 5 wt % of the lubricant formulation of an organic polymer comprising a hydrophobic polymeric sub unit comprising a polyisobutylene functionalized to comprise a diacid and/or anhydride group and a hydrophilic polymeric sub unit comprising a polyethylene glycol having a number average molecular weight of 400 to 1000 daltons; and iv) optionally, other additives, wherein the lubricant formulation reduces kinetic coefficient of friction by at least 5% and reduces wear of the first and/or second surface by at least 50% during operation of the lubricated system when compared with an equivalent lubricant formulation which does not comprise the molybdenum compound and the organic polymer.

2. A lubricated system according to claim 1 wherein the second surface is a metal surface.

3. A lubricated system according to claim 1 wherein the lubricated system is an automotive engine.

4. A lubricated system according to claim 1 wherein the hydrophobic polymeric sub unit comprises a polyisobutylene succinic anhydride.

5. A lubricated system according to claim 1 wherein the organic polymer further comprises a polyol.

6. A lubricated system according to claim 5 wherein the polyol is selected from glycerol, polyglycerol, neopentyl glycol, trimethylolethane, trimethylolpropane, trimethylolbutane, pentaerythritol, dipentaerythritol, tripentaerythritol, sucrose, sorbitan, sorbitol and mixtures thereof.

7. A lubricated system according to claim 1 wherein the organic polymer is a friction reducing additive.

8. A method of reducing wear in a lubricated system by at least 50% and kinetic coefficient of friction by at least 5% during operation of the lubricated system, wherein the lubricated system comprises a component with a DLC surface and wherein the method comprises the steps of:

a. providing a lubricant formulation to contact the DLC surface;

b. providing 0.05 to 5 wt % of the lubricant formulation of a molybdenum compound comprising a molybdenum dithiocarbamate (MoDTC) in the lubricant formulation to reduce friction in the lubricated system; and c. providing 0.05 to 5 wt % of the lubricant formulation of an organic polymer comprising a hydrophobic polymeric sub unit comprising a polyisobutylene functionalized to comprise a diacid and/or anhydride group and a hydrophilic polymeric sub unit comprising a polyethylene glycol having a number average molecular weight of 400 to 1000 daltons in the lubricant formulation to reduce the rate of wear and friction of the DLC surface during operation of the lubricated system.

* * * * *